US009170017B2

(12) United States Patent
Shimek et al.

(10) Patent No.: US 9,170,017 B2
(45) Date of Patent: Oct. 27, 2015

(54) FIRE CONTAINER ASSEMBLY

(75) Inventors: Daniel C. Shimek, Apple Valley, MN (US); Kent R. Shimek, San Francisco, CA (US); Anthony L. Shimek, Prior Lake, MN (US)

(73) Assignee: The Outdoor Greatroom Company LLLP, Eagan, MN (US)

( * ) Notice: Subject to any disclaimer, the term of this patent is extended or adjusted under 35 U.S.C. 154(b) by 1241 days.

(21) Appl. No.: 12/985,961

(22) Filed: Jan. 6, 2011

(65) Prior Publication Data

US 2012/0006316 A1 Jan. 12, 2012

Related U.S. Application Data

(60) Provisional application No. 61/292,713, filed on Jan. 6, 2010.

(51) Int. Cl.

| | |
|---|---|
| ***F23M 9/00*** | (2006.01) |
| ***F23C 7/00*** | (2006.01) |
| ***F23L 1/02*** | (2006.01) |

(52) U.S. Cl.

CPC . *F23C 7/004* (2013.01); *F23L 1/02* (2013.01); *F23D 2900/05001* (2013.01)

(58) Field of Classification Search

CPC ..... F23D 2900/14021; F23M 9/00
USPC ..... 126/500, 518, 519
See application file for complete search history.

(56) References Cited

U.S. PATENT DOCUMENTS

| | | | | |
|---|---|---|---|---|
| 3,221,662 | A * | 12/1965 | White | 415/198.1 |
| 3,418,651 | A | 12/1968 | Jacobson | |
| 3,424,542 | A | 1/1969 | Hirschberg et al. | |
| 3,808,802 | A | 5/1974 | Tanasawa | |
| 4,124,353 | A | 11/1978 | Prudhon et al. | |
| 5,055,031 | A | 10/1991 | Werner | |
| 5,154,059 | A | 10/1992 | Keller | |
| 5,674,066 | A | 10/1997 | Hausemann et al. | |
| 5,738,508 | A | 4/1998 | Dobbeling et al. | |
| 5,876,196 | A | 3/1999 | Knöpfel et al. | |
| 5,921,766 | A | 7/1999 | Dobbeling | |
| 6,098,406 | A | 8/2000 | Bolis et al. | |

(Continued)

FOREIGN PATENT DOCUMENTS

| | | | |
|---|---|---|---|
| DE | 20 2007 018 478 | U1 | 10/2008 |
| EP | 0 002 124 | A1 | 5/1979 |
| EP | 2 098 781 | A2 | 9/2009 |

OTHER PUBLICATIONS

International Search Report and Written Opinion for International Application No. PCT/US2011/020380 mailed Nov. 7, 2012.

(Continued)

*Primary Examiner* — Avinash Savani
(74) *Attorney, Agent, or Firm* — Merchant & Gould P.C.

(57) ABSTRACT

An air-intake assembly adapted for use with a fire container assembly includes a first plate and a plurality of vanes. The plurality of vanes is engaged to the first plate. Each of the vanes includes a first longitudinal side engaged to the first plate and an oppositely disposed second longitudinal side. The plurality of vanes defines a plurality of pathways. A chamber is cooperatively defined by the first plate and the plurality of vanes. The chamber extends through the first plate. The plurality of pathways swirl air about a longitudinal axis of the chamber.

32 Claims, 16 Drawing Sheets

(56) References Cited

U.S. PATENT DOCUMENTS

| | | | |
|---|---|---|---|
| 6,176,087 | B1 | 1/2001 | Snyder et al. |
| 6,196,835 | B1 | 3/2001 | Gutmark et al. |
| 6,261,088 | B1 | 7/2001 | Butler |
| 6,270,338 | B1 | 8/2001 | Eroglu et al. |
| 6,513,329 | B1 | 2/2003 | Snyder et al. |
| 6,733,279 | B2 | 5/2004 | Thigpen et al. |
| 7,097,448 | B2 | 8/2006 | Chesney |
| D621,873 | S * | 8/2010 | Tsai ..... D19/26 |
| 2004/0261780 | A1 | 12/2004 | Frink et al. |
| 2005/0227194 | A1 | 10/2005 | Weinberger |
| 2009/0016048 | A1 | 1/2009 | McBrien et al. |

OTHER PUBLICATIONS

Heat & Glo™, Modern Collection from www.fireside.com as viewed on Aug. 14, 2009, 12 pages.

* cited by examiner

FIRE CONTAINER ASSEMBLY

CROSS REFERENCE TO RELATED APPLICATION

This application claims the benefit of U.S. Provisional Patent Application Ser. No. 61/292,713, entitled "Fire Container Assembly and filed on Jan. 6, 2010, the disclosure of which is hereby incorporated by reference in its entirety.

BACKGROUND

Fire pits, fire pots, and fire bowls are used for a variety of purposes. For example, these devices can be used for decoration, lighting, heating, cooking, etc. The fire in these devices is generated from a fuel source including gel fuels, natural gas, liquefied petroleum gas, wood, etc.

SUMMARY

An aspect of the present disclosure relates to a fire container assembly. The fire container assembly includes a combustible fuel that is adapted to provide a flame when ignited. A container receives the combustible fuel. An air-intake assembly is disposed adjacent to the container. The air-intake assembly includes a first plate and a plurality of vanes that is engaged to the first plate. Each of the vanes has a first longitudinal side engaged to the first plate and an oppositely disposed second longitudinal side. The plurality of vanes defines a plurality of pathways. A chamber is cooperatively defined by the first plate and the plurality of vanes. The plurality of pathways directs air about a longitudinal axis of the chamber. A shield is disposed on the air-intake assembly. The shield has a body defining a bore that extends longitudinally through the body. The bore is generally aligned with the chamber of the air-intake assembly so that the bore receives the flame from the combustible fuel. The flame is directed about the longitudinal axis in response to air received in the chamber of the air-intake assembly.

Another aspect of the present disclosure relates to a fire container assembly. The fire container assembly includes a container defining a receptacle. A tube defines a bore that extends longitudinally through the tube. The bore is generally aligned with the receptacle. The tube includes a sidewall that longitudinally surrounds the bore. The sidewall is continuous. An air-intake assembly is disposed between the container and the tube. The air-intake assembly includes a first plate, a second plate and a plurality of vanes. The plurality of vanes engages the first plate to the second plate. Each of the vanes has a first longitudinal side engaged to the first plate and an oppositely disposed second longitudinal side engaged to the second plate. The plurality of vanes defines a plurality of pathways. A chamber is cooperatively defined by the first plate, the second plate and the plurality of vanes. The plurality of pathways is adapted to direct air about a longitudinal axis of the chamber.

Another aspect of the present disclosure relates to an air-intake assembly adapted for use with a fire container assembly. The air-intake assembly includes a first plate and a plurality of vanes. The plurality of vanes is engaged to the first plate. Each of the vanes includes a first longitudinal side engaged to the first plate and an oppositely disposed second longitudinal side. The plurality of vanes defines a plurality of pathways. A chamber is cooperatively defined by the first plate and the plurality of vanes. The chamber extends through the first plate. The plurality of pathways swirl air about a longitudinal axis of the chamber.

Another aspect of the present disclosure relates to an air-intake assembly configured to provide air to a fire. The air-intake assembly includes a first plate having a first surface and defining an opening extending from the first surface through the first plate. A plurality of vanes being engaged to the first surface of the first plate and extending outwardly from the first surface. Each vane has a first end and a second end. The second end is disposed a greater distance away from the opening than the first end. An axis extending from the center of the opening and substantially parallel to the first surface intersects at least two of the plurality of vanes. During operation, the air-intake assembly is configured to receive air from below the plate and to supply swirling air upwardly to the fire through the opening.

Another aspect of the present disclosure relates to a fire container assembly. The fire container assembly includes a container, an air-intake assembly and a shield. The container is adapted to receive a combustible fuel. The air-intake assembly is engaged to the container. The air-intake assembly has a body defining a chamber and a plurality of pathways. The chamber has a central axis. The plurality of pathways is configured to direct air about the central axis of the chamber. The shield is disposed adjacent to the air-intake assembly. The shield has a body defining a bore that extends longitudinally through the body. The bore is generally aligned with the chamber of the air-intake assembly so that the bore receives a flame from the combustible fuel. The flame is directed about the central axis in response to air received in the chamber of the air-intake assembly.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DRAWINGS

DETAILED DESCRIPTION

Reference will now be made in detail to the exemplary aspects of the present disclosure that are illustrated in the accompanying drawings. Wherever possible, the same reference numbers will be used throughout the drawings to refer to the same or like structure.

Terms such as "uppermost," "lowermost," "upper," "lower," "top," "bottom," etc. are used throughout the description and in the appended claims. These terms are meant to serve as a frame of reference for the accompanying drawings. These terms are not intended to limit the scope of the present disclosure.

Figure 1:
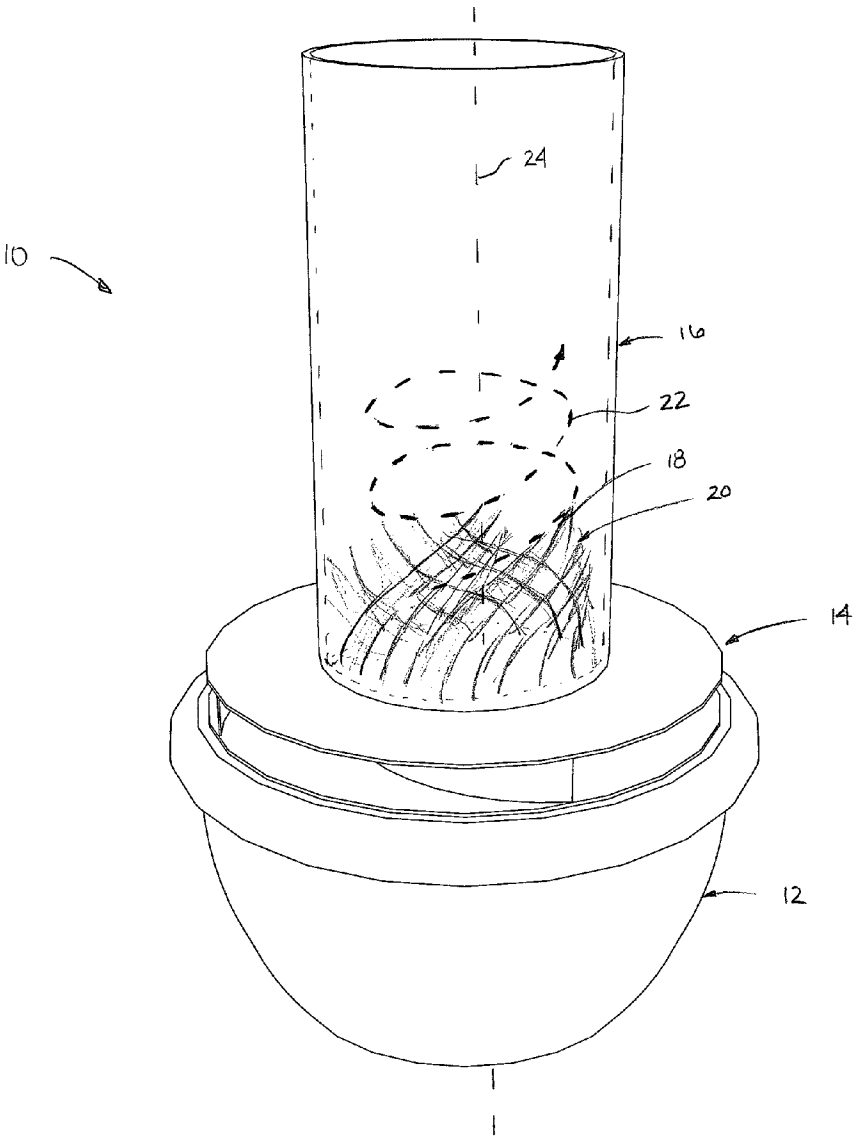
FIG. 1 is a perspective view of an example fire container assembly.
Figure 2:
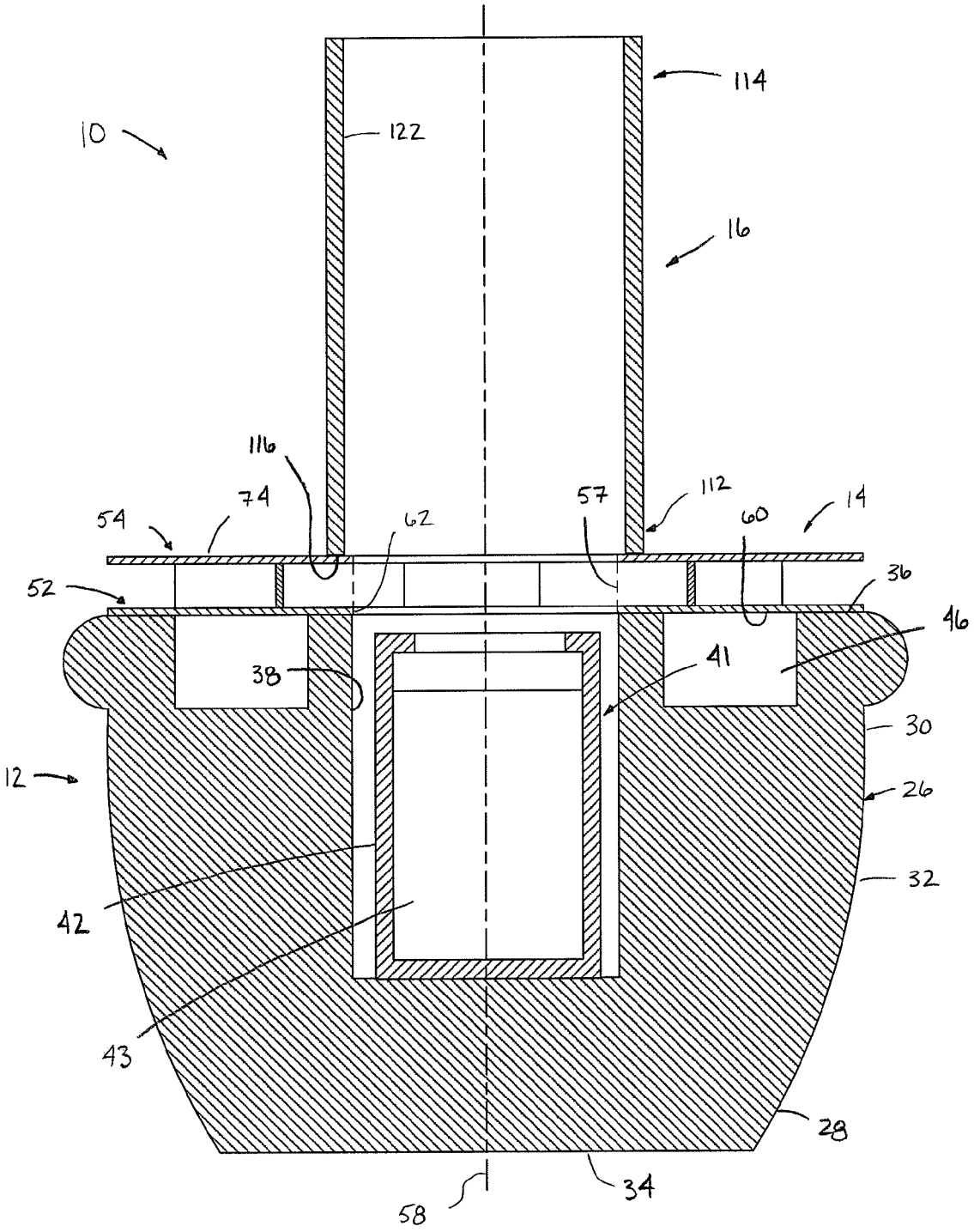
FIG. 2 is a cross-sectional view of the fire container assembly of FIG. 1.

Referring now to FIGS. 1 and 2, a fire container assembly, generally designated 10, is shown. The fire container assembly 10 includes a container 12, an air-intake assembly 14 disposed adjacent to the container 12 and a shield 16. In the depicted embodiment of FIGS. 1 and 2, the air-intake assembly 14 is disposed immediately between the container 12 and the shield 16. In the depicted embodiment, the fire container assembly 10 is adapted for indoor and/or outdoor use. The fire container assembly 10 can also be stationary or portable.

The fire container assembly 10 is adapted to alter the direction of flames 18 of a fire 20. In one aspect of the present disclosure, the fire container assembly 10 directs the flames 18 of the fire 20 in a generally circular or helical direction (shown as a dashed arrow having reference numeral 22) about a central longitudinal axis 24 of the fire container assembly 10 so that the flames 18 swirl within the shield 16.

Referring now to FIGS. 1-4, the container 12 will be described. In the embodiment of FIGS. 1-4, the container 12 is depicted as a fire pot. It will be understood, however, that the scope of the present disclosure is not limited to the container 12 being a fire pot as the container 12 could include a fire pit, a fire bowl, a fireplace, a lantern base, a lamp base, a fuel canister, a table, a tabletop, etc.

The container 12 includes a body 26 having a first axial end 28, an oppositely disposed second axial end 30 and a sidewall 32 that extends between the first and second axial ends 28, 30. In the depicted embodiment of FIG. 2, the first axial end 28 is the lowermost portion of the body 26 while the second axial end 30 is the uppermost portion of the body 26. The first axial end 28 includes a first end surface 34 that is generally planar in shape while the second axial end 30 includes a second end surface 36. In the depicted embodiment, the first end surface 34 is the bottom surface of the container 12 while the second end surface 36 is the top surface of the container 12.

The body 26 defines a receptacle 38. In the depicted embodiment, the receptacle 38 has a depth that is less than the distance between the first and second end surfaces 34, 36 of the body 26 so that the receptacle 38 does not extend through to the first end surface 34. In the depicted embodiment, however, the body 26 defines a drain hole 39 that extends from the receptacle 38 through the first end surface 34. The drain hole 39 is adapted to allow water to drain from the receptacle 38. The receptacle 38 includes an opening 40 that is defined by the second end surface 36 of the body 26.

The receptacle 38 is adapted to receive a combustible fuel 41 (e.g., gel fuel, bio fuel, natural gas, liquefied petroleum gas, denatured alcohol, fuel pellets, kerosene, oil, wood, wick, combinations thereof, etc.) that fuels the fire 20 when ignited. In the depicted embodiment of FIG. 2, the combustible fuel 41 is a gel fuel. The gel fuel 41 includes a canister 42 having a removable top and a flammable gel 43 disposed in the canister 42. The canister 42 includes an opening in a top section of the canister 42 through which the flames 18 pass. The size of the opening influences the rate at which the gel 43 burns. In another embodiment, the combustible fuel 41 is a gel fuel/pellet combination.

Figure 3:
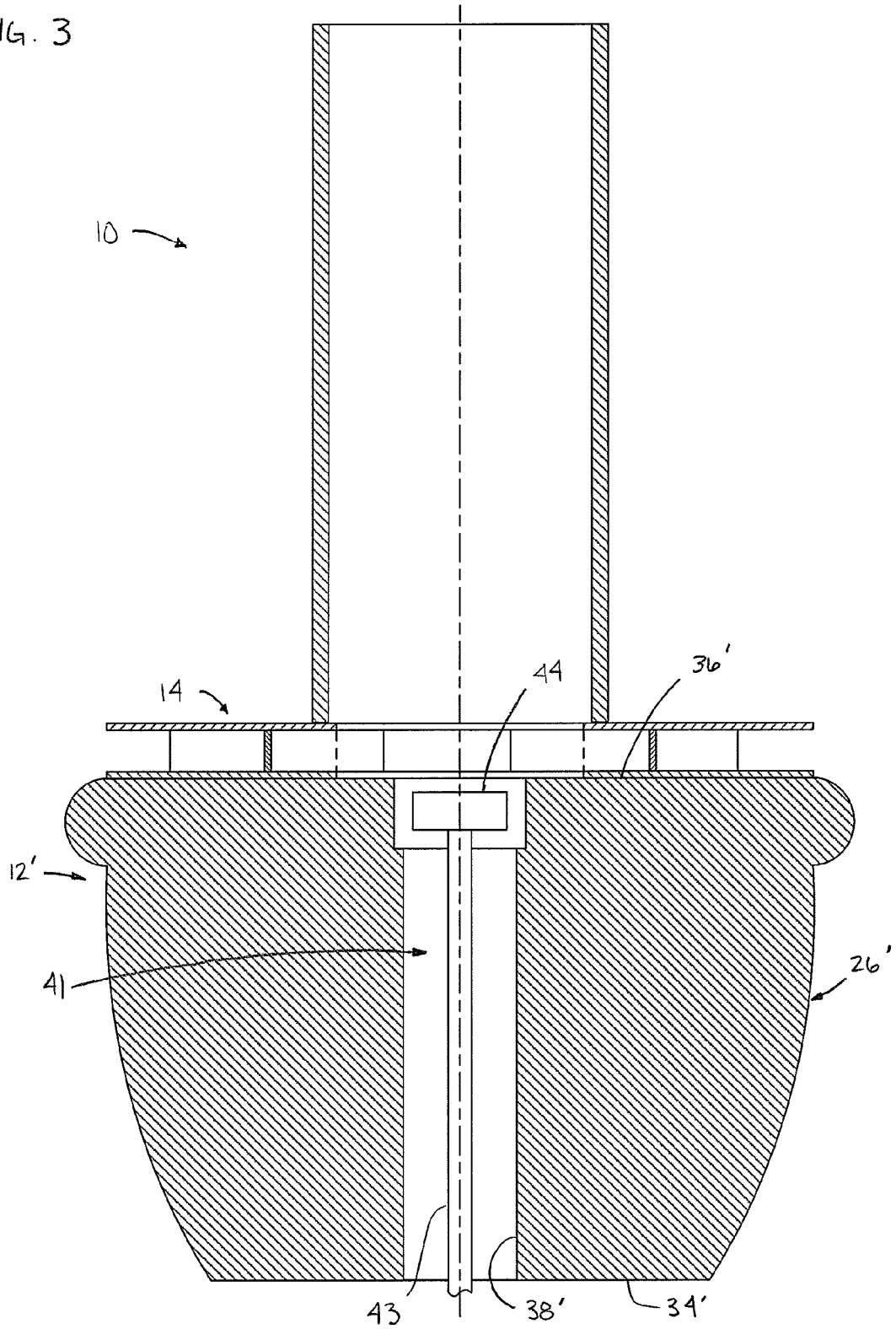
FIG. 3 is a cross-sectional view of the fire container assembly of FIG. 1 using an alternate combustible fuel source.

Another example of the fire container assembly 10 is shown in FIG. 3. In the depicted embodiment of FIG. 3, the combustible fuel 41 is a combustible gas, such as natural gas or liquefied petroleum gas. The combustible gas 41 passes through a conduit 43 (e.g., tubing, pipe, etc.) and into a burner 44. The burner 44 generates the flames 18 (shown in FIG. 1) of the fire 20 (shown in FIG. 1).

A portion of the conduit 43 and the burner 44 extends through a receptacle 38' defined by a body 26' of a container 12'. The receptacle 38' extends through the body 26' from a first end surface 34' through a second end surface 36' of the body 26'. The burner 44 is disposed in the receptacle 38' so that it is below the second end surface 36'. In this embodiment, the lowermost point of the flame 18 is disposed below the second end surface 36'. In the depicted embodiment of FIG. 3, the burner 44 is disposed below the air-intake assembly 14 so that the lowermost point (or the point of ignition) of the flame 18 is disposed below the air-intake assembly 14. In another embodiment, the burner 44 is disposed above the air-intake assembly 14 so that the lowermost point of the flame 18 is disposed above the air-intake assembly 14.

Figure 4:
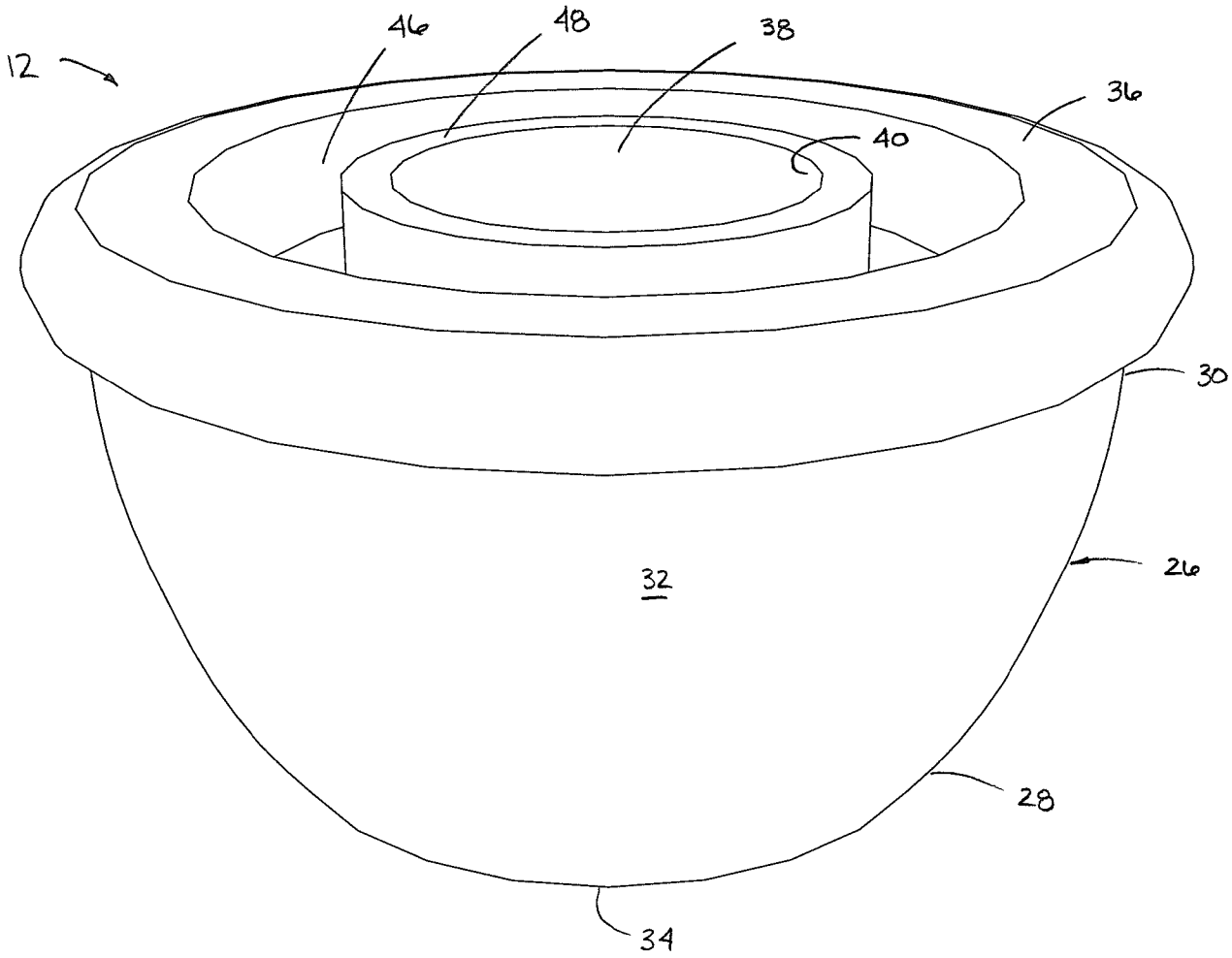
FIG. 4 is a perspective view of a container suitable for use with the fire container assembly of FIG. 1.

In the depicted embodiment of FIGS. 2 and 4, the body 26 of the container 12 further defines an outer receptacle 46. The outer receptacle 46 is concentric with the receptacle 38. An inner wall 48 separates the receptacle 38 from the outer receptacle 46.

Referring now to FIGS. 1, 2 and 5-10, the air-intake assembly 14 will be described. In the depicted embodiment of FIG. 1, the air-intake assembly 14 is disposed on the second end surface 36 of the container 12. The air-intake assembly 14 is adapted to provide a path through which air (i.e., oxygen) enters the fire container assembly 10.

In the depicted embodiment, the air-intake assembly 14 includes a bottom plate 52, a top plate 54 and a plurality of vanes 55 disposed between the bottom and top plates 52, 54. While the bottom and top plates 52, 54 are shown as being generally planar in shape in the depicted embodiment, any one or more of the bottom and top plates 52, 54 can have one of various configurations (e.g., non-uniform, non-planar, arcuate, etc.). In the subject embodiment, the vanes 55 are stationary with respect to the bottom and top plates 52, 54. While the bottom and top plates 52, 54 are shown in the figures, in some embodiments (e.g., FIG. 19), the use of the bottom plate 52 in the air-intake assembly 14 is not necessary.

The bottom plate 52, the top plate 54 and the plurality of vanes 55 cooperatively define a plurality of pathways 56. The plurality of pathways 56 (shown as arrows in FIGS. 8-10) lead to a chamber 57 defined by the bottom plate 52, the top plate 54 and the plurality of vanes 55. In the depicted embodiment, the chamber 57 is centrally disposed in the air-intake assembly 14. A central longitudinal axis 58 extends through the chamber 57.

In one aspect of the present disclosure, the plurality of pathways 56 of the air-intake assembly 14 causes air that enters the air-intake assembly 14 to be directed about the central longitudinal axis 58 of the chamber 57. In the depicted embodiment, the plurality of pathways 56 causes air to swirl about the central longitudinal axis 58 of the chamber 57. This direction or swirling of air about the central longitudinal axis 58 causes the flames 18 of the fire 20 to be directed or swirled about central longitudinal axis 58 in the fire container assembly 10.

The bottom plate 52 of the air-intake assembly 14 is generally planar in shape. While in the depicted embodiment the bottom plate 52 is generally circular in shape, it will be understood that the bottom plate 52 can be various shapes (e.g., circular, square, rectangular, triangular, etc.). In some embodiments, the bottom plate 52 is metallic (e.g., steel, aluminum, etc.). The metal of the bottom plate 52 may be coated with an ultra violet ("UV") powder coating. In other embodiments, the bottom plate 52 is plastic.

The bottom plate 52 includes a first axial end surface 59 and an oppositely disposed second axial end surface 60. The bottom plate 52 defines a first opening 62 to the chamber 57 that extends through the first and second axial end surfaces 59, 60. In the depicted embodiment, the first opening 62 is cylindrical in shape. The bottom plate 52 includes a first inner portion 63 having a first inner surface 64 disposed at the first opening 62 and an oppositely disposed first outer portion 65 having a first outer surface 66. The first inner surface 64 defines a first inner diameter $D_1$. In the depicted embodiment, a center of the first inner diameter $D_1$ is aligned with the central longitudinal axis 58.

The second axial end surface 60 of the bottom plate 52 is adapted to abut the second end surface 36 of the container 12. The second axial end surface 60 includes a plurality of tabs 68. In the depicted embodiment of FIG. 6, there are four tabs 68. Some embodiments do not include tabs 68.

The plurality of tabs 68 is adapted to generally align the air-intake assembly 14 with the container 12. Each of the tabs 68 includes a base end 70 and a free end 72. The base end 70 is engaged to the bottom plate 52 while the free end 72 extends outwardly from the second axial end surface 60. In one embodiment, the base end 70 of each of the tabs 68 is integral with the bottom plate 52. A portion of the free end 72 of each of the tabs 68 is disposed in the outer receptacle 46.

The top plate 54 is similar in shape to the bottom plate 52. In some embodiments, the top plate 54 is metallic (e.g., steel, aluminum, etc.). The metal of the top plate 54 may be coated with a UV powder coating. In other embodiments, the top plate 54 is plastic.

Figure 5:
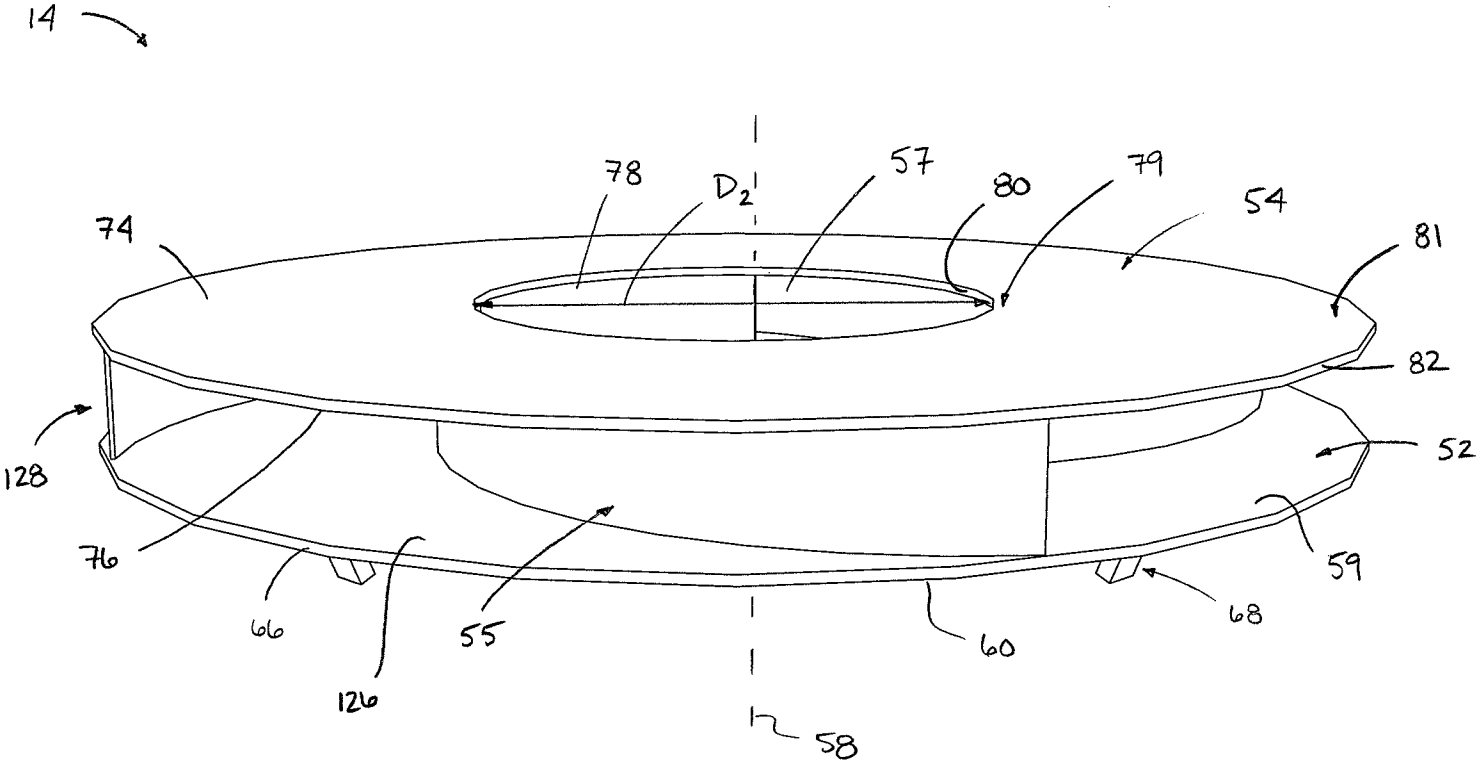
FIG. 5 is a perspective view of an example air-intake assembly suitable for use with the fire container assembly of FIG. 1.
Figure 6:
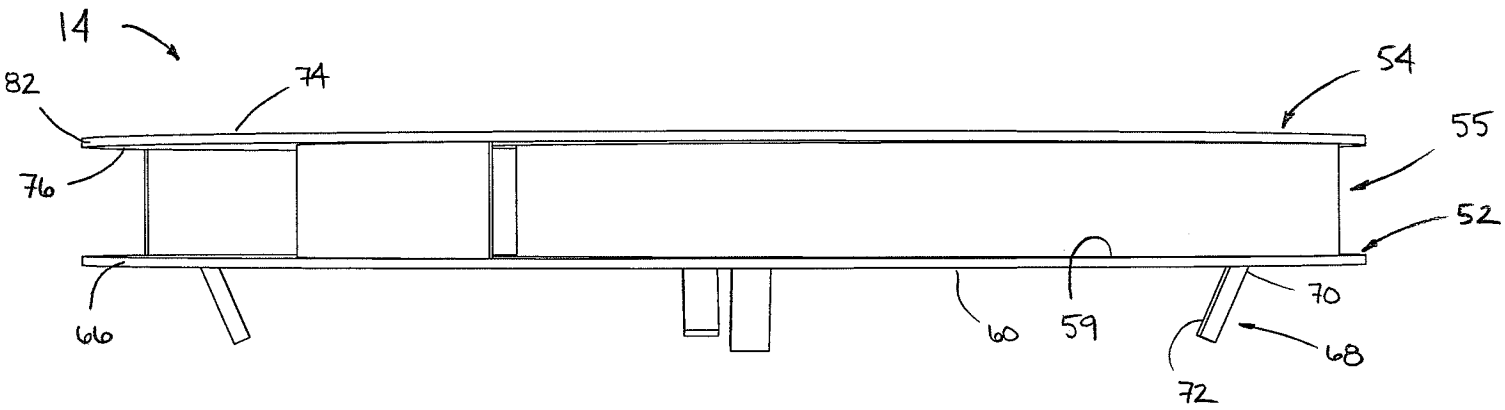
FIG. 6 is a side view of the air-intake assembly of FIG. 5.
Figure 7:
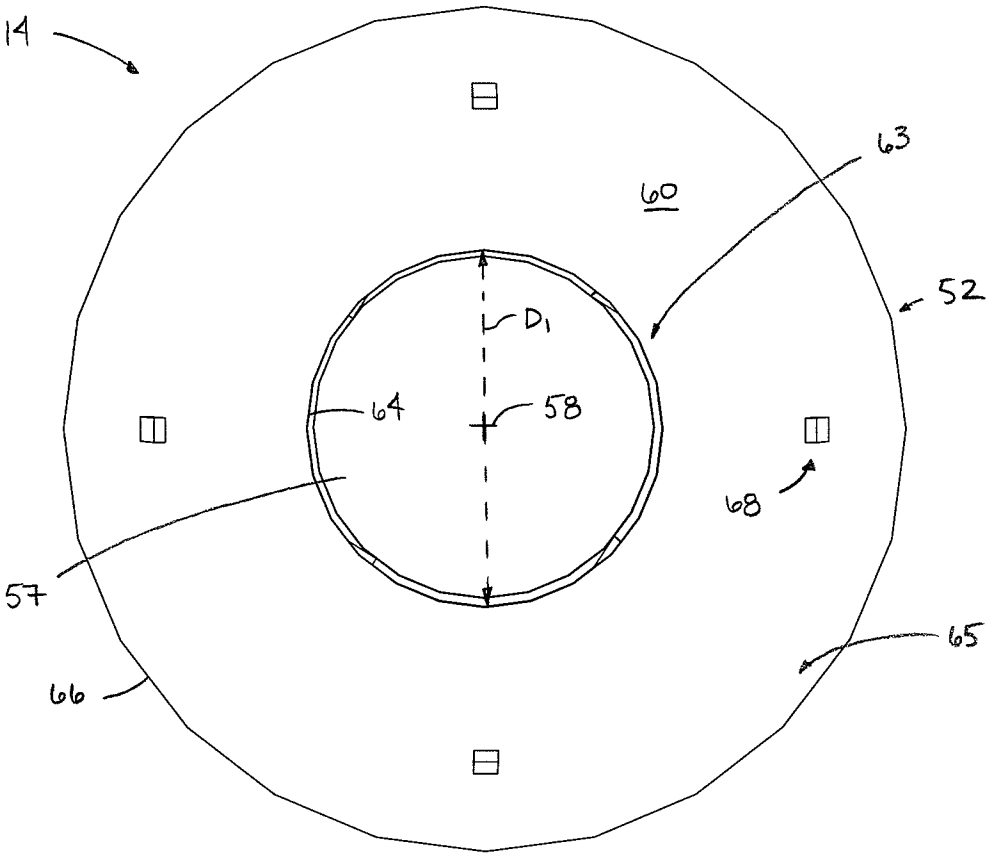
FIG. 7 is a bottom view of the air-intake assembly of FIG. 5.

The top plate 54 (such as shown in FIG. 5) includes a first axial end 74 and an oppositely disposed second axial end 76. The top plate 54 defines a second opening 78 that extends through the first and second axial ends 74, 76. In the depicted embodiment, the second opening 78 is cylindrical in shape. The top plate 54 includes a second inner portion 79 having a second inner surface 80 disposed at the second opening 78 and an oppositely disposed second outer portion 81 having a second outer surface 82. The second inner surface 80 defines a second inner diameter $D_2$. In the depicted embodiment, the second inner diameter is about equal to the first inner diameter $D_1$ (shown in FIG. 7). A center of the second inner diameter is aligned with the central longitudinal axis 58.

Figure 8:
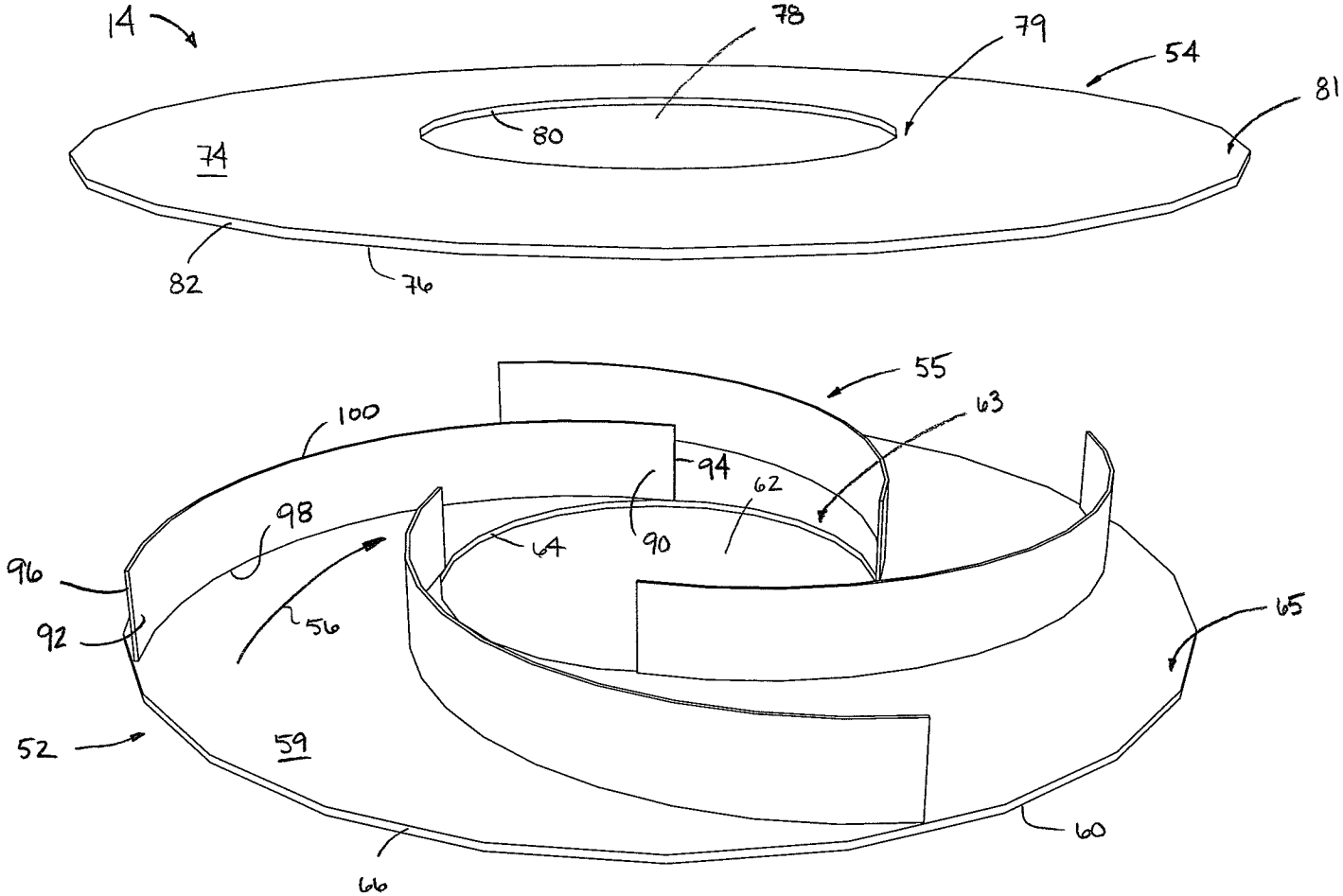
FIG. 8 is an exploded perspective view of the air-intake assembly of FIG. 5.
Figure 9:
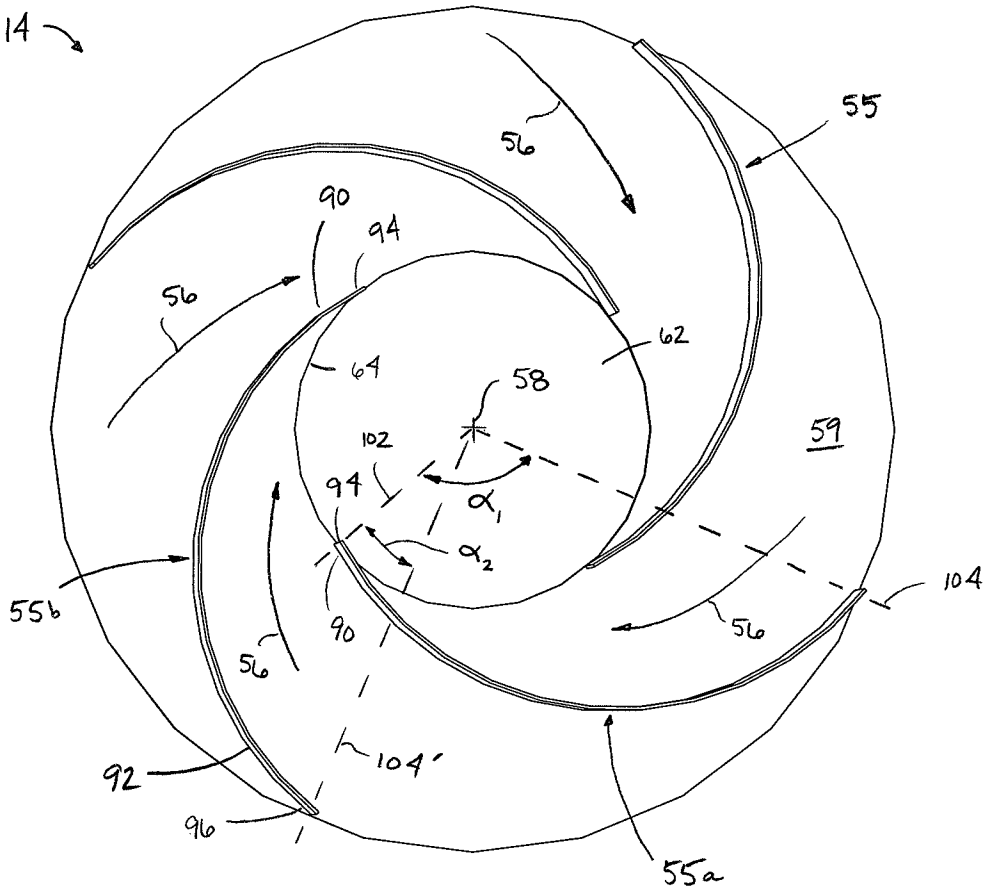
FIG. 9 is a top view of the air-intake assembly of FIG. 5 with a second plate removed from the air-intake assembly.
Figure 10:
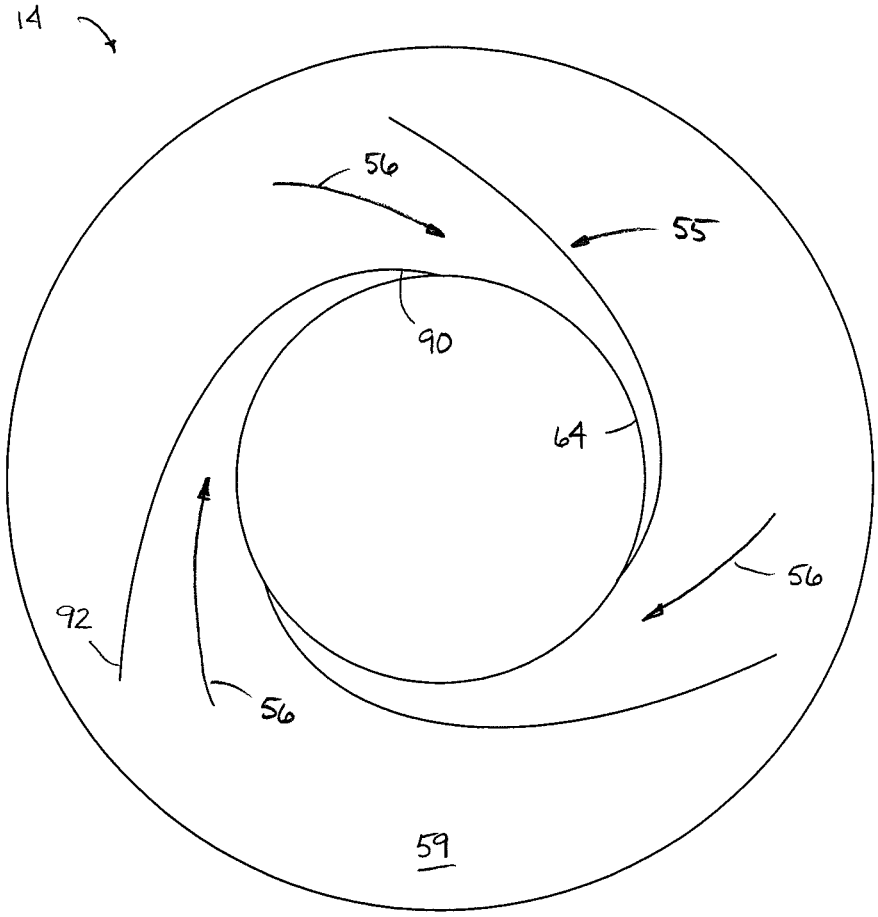
FIG. 10 is a top view of another example of the air-intake assembly of FIG. 5 with the second plate removed from the air-intake assembly.

Referring now to FIGS. 8-10, the vanes 55 will be described. Each of the vanes 55 is a thin piece of material that is engaged to the bottom and top plates 52, 54 of the air-intake assembly 14. In the depicted embodiment of FIG. 9, the air-intake assembly 14 includes at least four vanes 55. In the depicted embodiment of FIG. 10, the air-intake assembly 14 includes at least three vanes 55. In another embodiment, the air-intake assembly 14 includes at least two vanes 55.

Each of the vanes 55 includes a first end portion 90 and a second end portion 92. The first end portion 90 includes a first end 94 while the second end portion 92 includes a second end 96. Each of the vanes 55 further includes a first longitudinal side 98 that extends between the first and second end 94, 96 and an oppositely disposed second longitudinal side 100 that extends between the first and second ends 94, 96.

In some embodiments, the vanes 55 are disposed between the bottom and top plates 52, 54. In the depicted embodiment, the first longitudinal side 98 of each of the vanes 55 is fastened (e.g., welded, screwed, bolted, adhered, etc.) to the first axial end surface 59 of the bottom plate 52 while the second longitudinal side 100 is fastened (e.g., welded, screwed, bolted, adhered, etc.) to the second axial end 76 of the top plate 54. Each of the vanes 55 is stationary with respect to the bottom and top plates 52, 54.

In other embodiments, the vanes 55 extend outwardly from the second axial end 76 of the top plate 54. In these embodiments, the second longitudinal side 100 is fastened to the second axial end 76 of the top plate 54 while the first longitudinal side 98 of the vanes 55 is adapted to abut a surface of the container 12.

The first end 94 of each of the vanes 55 is adjacent to the first and second openings 62, 78. In the depicted embodiment, the first end 94 of each of the vanes 55 is disposed at the first and second inner surfaces 64, 80 of the bottom and top plates 52, 54. In one embodiment, the first end 94 of each of the vanes 55 is generally tangential to the first inner surface 64 of the bottom plate 52. The second end 96 of each of the vanes 55 extends outwardly from the first and second openings 62, 78 of the bottom and top plates 52, 54 so that the second end 96 of each of the vanes 55 is disposed adjacent to the first and second outer surfaces 66, 82 of the bottom and top plates 52, 54. The vanes 55 are symmetrically arranged about the first and second openings 62, 78 of the bottom and top plates 52, 54.

A first axis 102 (such as shown in FIG. 9) is defined by the first end 94 of a first vane 55*a* and the central longitudinal axis 58 of the chamber 57. A second axis 104 is defined by the second end 96 of the first vane 55*a* and the central longitudinal axis 58 of the chamber 57. In the depicted embodiment of FIG. 9, the second axis 104 of the first vane 55*a* is disposed at a first angle $\alpha_1$ from the first axis 102 of the first vane 55*a*. The first angle $\alpha_1$ is greater than 360° divided by the total number N of vanes 55 (i.e., $\alpha_1$>360°/N). In the depicted embodiment of FIG. 9, the first angle $\alpha_1$ is greater than 90° ($\alpha_1$>360°/4) since there are four vanes 55 (i.e., N=4). The second ends 96 of the vanes 55 circumferentially overlap the first ends 94 of the immediately subsequent vanes 55. The circumferential overlap between the second ends 96 of the vanes 55 and the first ends 94 of the immediately subsequent vanes 55 directs air (i.e., oxygen) about the central longitudinal axis 58 of the chamber 57. The circumferential overlap between the second ends 96 of the vanes 55 and the first ends 94 of the immediately subsequent vanes 55 prevents air from flowing radially through the air-intake assembly 14 toward the central longitudinal axis 58.

The second end 96 of a second vane 55*b*, which immediately precedes the first vane 55*a*, and the central longitudinal axis 58 of the chamber 57 define a second axis 104'. The second axis 104' of the second vane 55*b* is angularly offset from the first axis 102 of the first vane 55*a* by a second angle $\alpha_2$. This second angle $\alpha_2$ provides the angular overlap between the second end 96 of the second vane 55*b* and the first end 94 of the first vane 55*a*. In the depicted embodiment of FIG. 9, the difference Δ between the between the first and second angles $\alpha_1$, $\alpha_2$ is equal to 360° minus the number N of vanes 55 (i.e., $\Delta=\alpha_1-\alpha_2=360°/N$).

In the depicted embodiment of FIGS. 8-10, the first end portion 90 of each of the vanes 55 has a shape that is arcuate or curved. In one aspect of the present disclosure, this arcuate shape aids in directing air about the central longitudinal axis 58 of the chamber 57.

Figure 11:
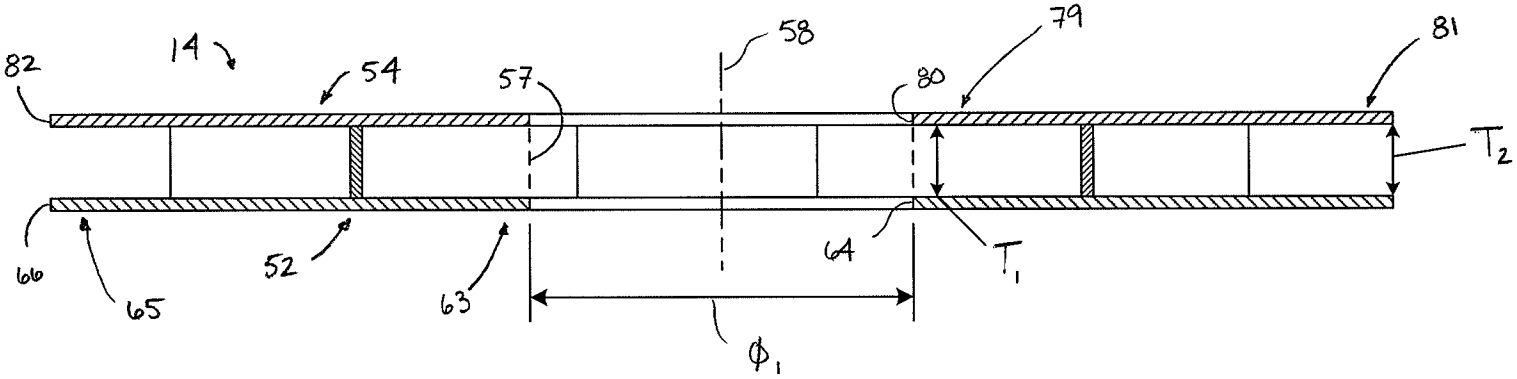
FIG. 11 is a cross-sectional view of the air-intake assembly taken on line 11-11 of FIG. 6.

Referring now to FIG. 11, an exemplary cross-sectional view of the air-intake assembly 14 is shown. The air-intake assembly 14 defines an inner thickness $T_1$ and an outer thickness $T_2$. The inner thickness $T_1$ is measured between the bottom and top plates 52, 54 at chamber 57 (i.e., between the first and second inner surfaces 64, 80 of the bottom and top plates 52, 54). The outer thickness $T_2$ is measured between the first and second outer portions 65, 81 at the first and second outer surfaces 66, 82 of the bottom and top plates 52, 54. In the depicted embodiment of FIG. 11, the inner and outer thicknesses $T_1$, $T_2$ are about equal.

The inner thickness $T_1$ of the air-intake assembly 14 affects the degree of swirling of the flames 18 (shown in FIG. 1) about the central longitudinal axis 58. In one aspect of the present disclosure, the inner thickness $T_1$ of the air-intake assembly 14 is greater than or equal to about 0.125 inches. In another aspect of the present disclosure, the inner thickness $T_1$ of the air-intake assembly 14 is greater than or equal to about 0.5 inches. In another aspect of the present disclosure, the inner thickness $T_1$ of the air-intake assembly 14 is greater than or equal to about 0.625 inches. In another aspect of the present disclosure, the inner thickness $T_1$ of the air-intake assembly 14 is greater than or equal to about 2 inches. In another aspect of the present disclosure, the inner thickness $T_1$ of the air-intake assembly 14 is in a range of about 0.5 inches to about 4 inches. In another aspect of the present disclosure, the inner thickness $T_1$ of the air-intake assembly 14 is in a range of about 0.75 inches to about 3 inches. In another aspect of the present disclosure, the inner thickness $T_1$ of the air-intake assembly 14 is in a range of about 0.75 inches to about 1 inch. In another aspect of the present disclosure, the inner thickness $T_1$ of the air-intake assembly 14 is in a range of about 2 inches to about 3 inches.

In one aspect of the present disclosure, the inner thickness $T_1$ of the air-intake assembly 14 is a function of the width of the chamber 57. In the depicted embodiment, the chamber 57 is generally cylindrical in shape. Therefore, in the depicted embodiment, the inner thickness $T_1$ of the air-intake assembly 14 is a function of an inner diameter $\phi_1$ of the chamber 57. In one embodiment, the inner thickness $T_1$ is less than or equal to about 50% of the inner diameter $\phi_1$ of the chamber 57. In another embodiment, the inner thickness $T_1$ is less than or equal to about 30% of the inner diameter $\phi_1$ of the chamber 57. In the subject embodiment, the inner thickness $T_1$ is about 20% to about 30% of the inner diameter $\phi_1$ of the chamber 57.

Figure 12:
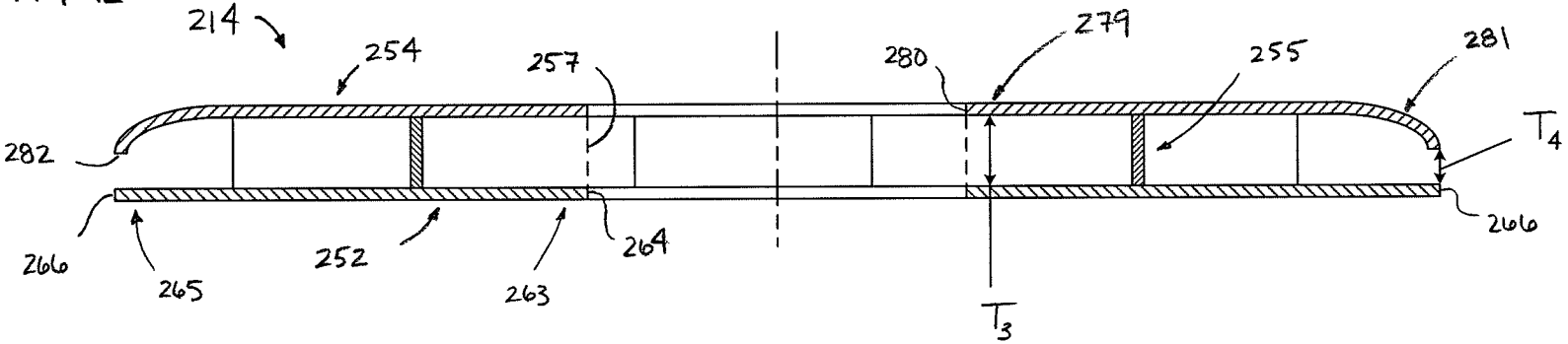
FIG. 12 is a cross-sectional view of an alternate embodiment of an air-intake assembly.

Referring now to FIG. 12, an exemplary cross-sectional view of an alternate embodiment of an air-intake assembly 214 is shown. The air-intake assembly 214 is structurally similar to the air-intake assembly 14 described above.

The air-intake assembly 214 includes a first plate 252, a second plate 254 and a plurality of vanes 255. The first plate 252, the second plate 254 and the plurality of vanes 255 cooperatively define a chamber 257.

The first plate 252 is generally planar in shape. The first plate 252 includes a first inner portion 263 having a first inner surface 264 and a first outer portion 265 having a first outer surface 266.

The second plate 254 includes a second inner portion 279 having a second inner surface 280 and a second outer portion 281 having a second outer surface 282. In the depicted embodiment of FIG. 11, the second outer portion 281 of the second plate 254 tapers or is oriented toward the first plate 252.

The air-intake assembly 214 includes an inner thickness $T_3$, which is measured between the bottom and top plates 252, 254 at chamber 257 (i.e., between the first and second inner portions 263, 279 at the first and second inner surfaces 264, 280 of the bottom and top plates 252, 254), and an outer thickness $T_4$, which is measured between the first and second outer portions 265, 281 of the bottom and top plates 252, 254. In the depicted embodiment of FIG. 11, the inner thickness $T_3$ is greater than the outer thickness $T_4$.

Figure 14:
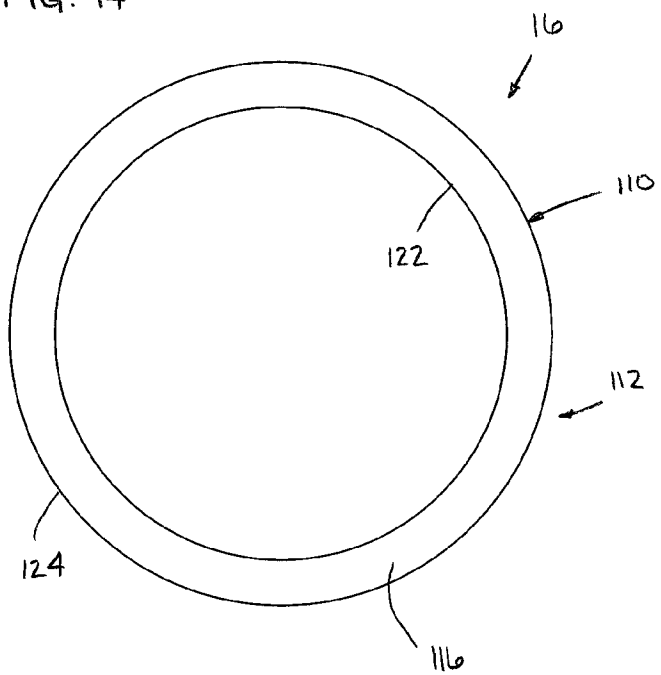
FIG. 14 is a bottom view of the shield of FIG. 13.
Figure 13:
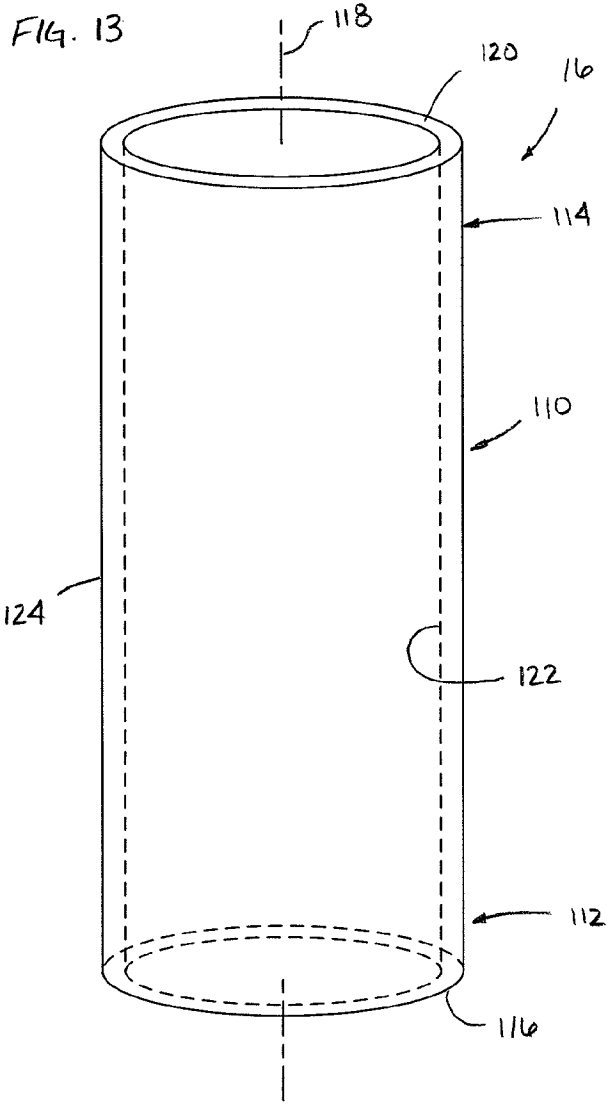
FIG. 13 is a perspective view of a shield suitable for use with the fire container assembly of FIG. 1.
Figure 16:
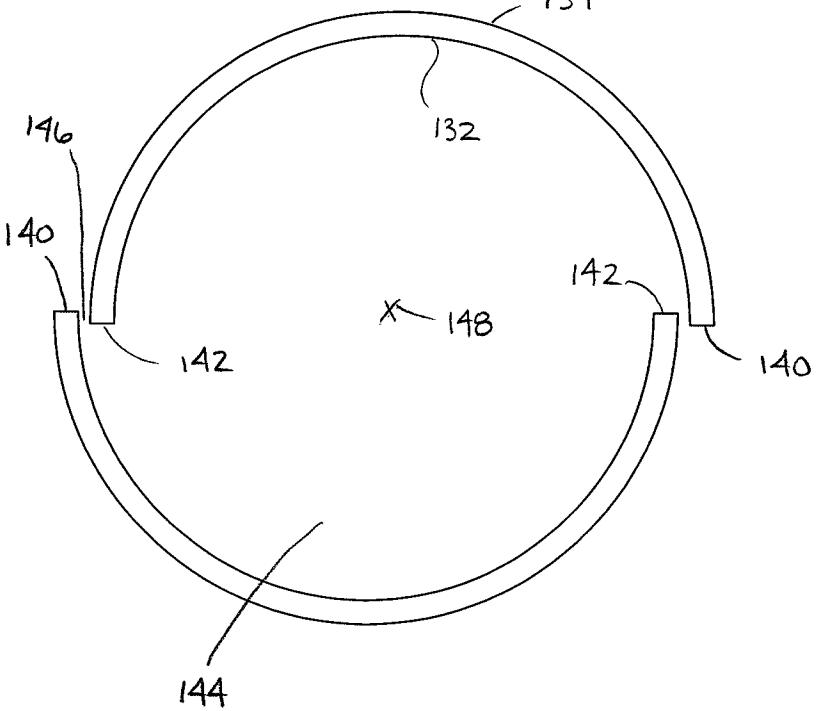
FIG. 16 is a bottom view of the shield of FIG. 15.
Figure 15:
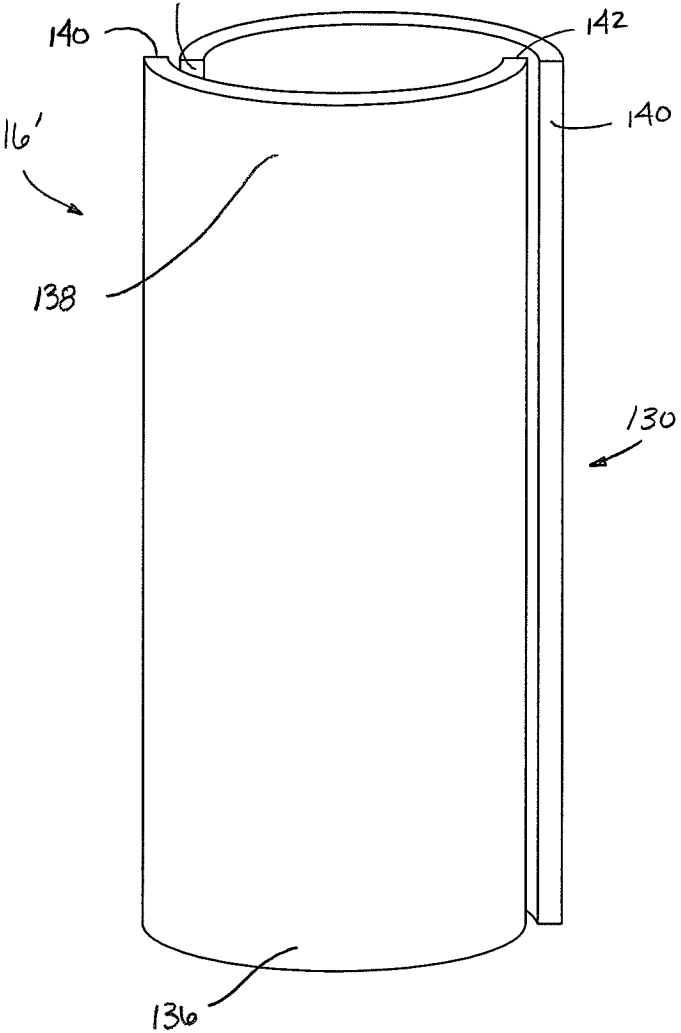
FIG. 15 is a perspective view of an alternate embodiment of a shield.
Figure 18:
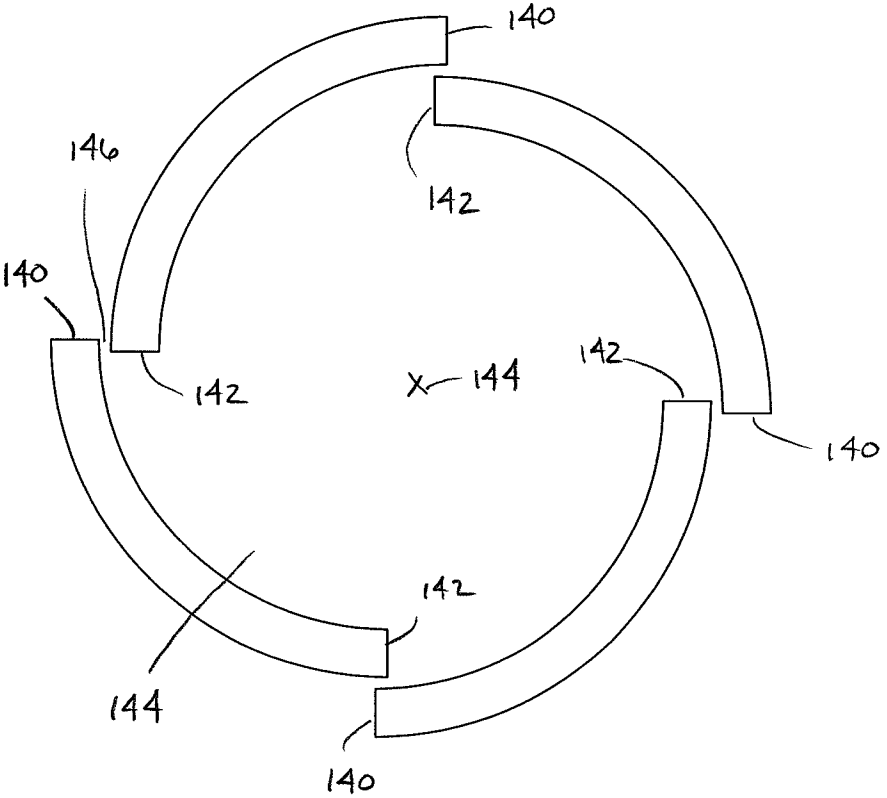
FIG. 18 is a bottom view of the shield of FIG. 17.
Figure 17:
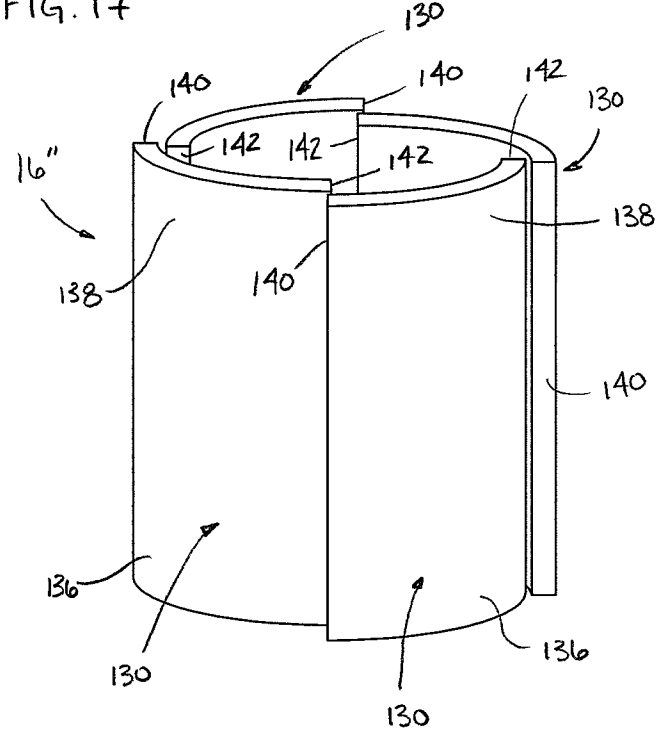
FIG. 17 is a perspective view of an alternate embodiment of a shield.

Referring now to FIGS. 1, 13 and 14, the shield 16 will be described. In some embodiments, the shield 16 is a tube that is adapted to surround at least a portion of the flames 18. While the shield 16 can have various shapes (e.g., square, cylindrical, frusto-spherical, etc.), the shield 16 is shown as being generally cylindrical in shape in the depicted embodiment.

The shield 16 includes a body 110 having a first axial end portion 112 and an oppositely disposed second axial end portion 114. The first axial end portion 112 includes a first end surface 116. The first end surface 116 is generally perpendicular to a longitudinal axis 118 defined by the body 110. The second axial end portion 114 includes a second end surface 120. In the depicted embodiment, the second end surface 120 is generally perpendicular to the longitudinal axis 118.

The body 110 defines a bore 122 that extends through the first and second end surfaces 116, 120. The bore 122 is adapted to receive the flames 18 from the combustible fuel 41. The body 110 includes a sidewall 124 that extends from the first end surface 116 to the second end surface 120. The sidewall 124 of the shield 16 surrounds a perimeter of the bore 122. The sidewall 124 is continuous so that air is prevented from entering the bore 122 through the sidewall 124 of the shield 16.

In one embodiment, the body 110 of the shield 16 is transparent so that the flames 18 (shown in FIG. 1) can be viewed through the shield 16. In another embodiment, the body 110 is made of glass.

Referring now to FIGS. 15-18, alternate embodiments of a shield 16' are shown. The shield 16' includes a plurality of plates 130. In the depicted embodiments of FIGS. 15-16, the shield 16' includes at least two plates 130. In the depicted embodiment of FIGS. 17-18, the shield 16' includes at least four plates 130.

Each of the plates 130 includes an inner surface 132, an oppositely disposed outer surface 134. Each of the plates 130 further includes a first axial end 136, an oppositely disposed second axial end 138, a first longitudinal edge 140 and an oppositely disposed second longitudinal edge 142. The first axial ends 136 of the plates 130 are adapted for engagement with the first axial end 74 of the top plate 54 of the air-intake assembly 14 (shown in FIGS. 11-12).

Each of the plates 130 is arranged so that the inner surfaces 132 of the plates 130 cooperatively define an inner region 144 of the shield 16'. In the depicted embodiments of FIGS. 15-18, each of the plates 130 is arranged so that the first longitudinal edge 140 overlaps the second longitudinal edge 142 of the immediately adjacent plate 130.

The plates 130 define a plurality of air gaps 146 between the first and second longitudinal edges 140, 142 of adjacent plates 130. The air gaps 146 permit air to enter the interior region 144 of the shield 16'. By allowing air to enter the interior region 144 of the shield 16' through the air gaps 146 in the shield 16', the temperature of the shield 16' during operation of the fire container assembly 10 is reduced as compared to a shield having no air gaps 146. The overlap between the first and second longitudinal edges 140, 142 causes the air that enters the interior region 144 to be directed about a central longitudinal axis 148 (shown as an "X" in FIGS. 16 and 18) of the interior region 144.

Figure 19:
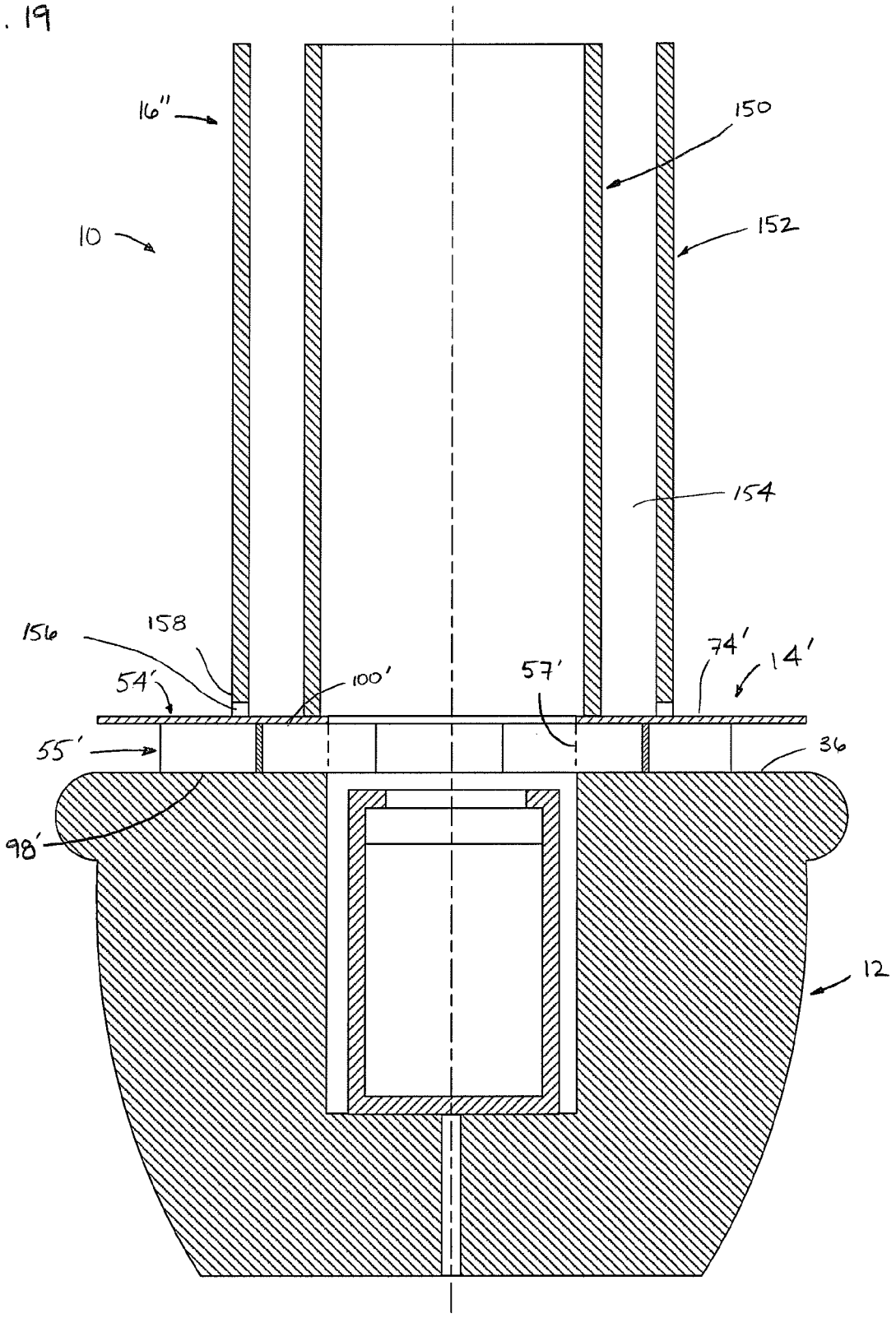
FIG. 19 is a cross-sectional view of an alternate embodiment of a fire container assembly.

Referring now to FIG. 19, an alternate embodiment of the fire container assembly 10 is shown. In the depicted embodiment of FIG. 19, the fire container assembly 10 includes a shield 16" having an inner shield 150 and an outer shield 152. The inner shield 150 is similar to the shield 16 described above.

The outer shield 152 includes an inner diameter that is greater than an outer diameter of the inner shield 150. In the depicted embodiment of FIG. 19, the inner and outer shield 150, 152 are concentrically arranged on the air-intake assembly 14. The concentric arrangement of the inner and outer shields 150, 152 and the inner diameter of the outer shield 152 being larger than the outer diameter of the inner shield 150 defines an air passage 154 between the outer diameter of the inner shield 150 and the inner diameter of the outer shield 152. An opening 156 is disposed between the first axial end 74 of the top plate 54 of the air-intake assembly 14 and a first axial end 158 of the outer shield 152. The opening 156 is adapted to allow air to enter the air passage 154. The air passage 154 provides for a temperature differential between the inner and outer shields 150, 152.

Figure 20:
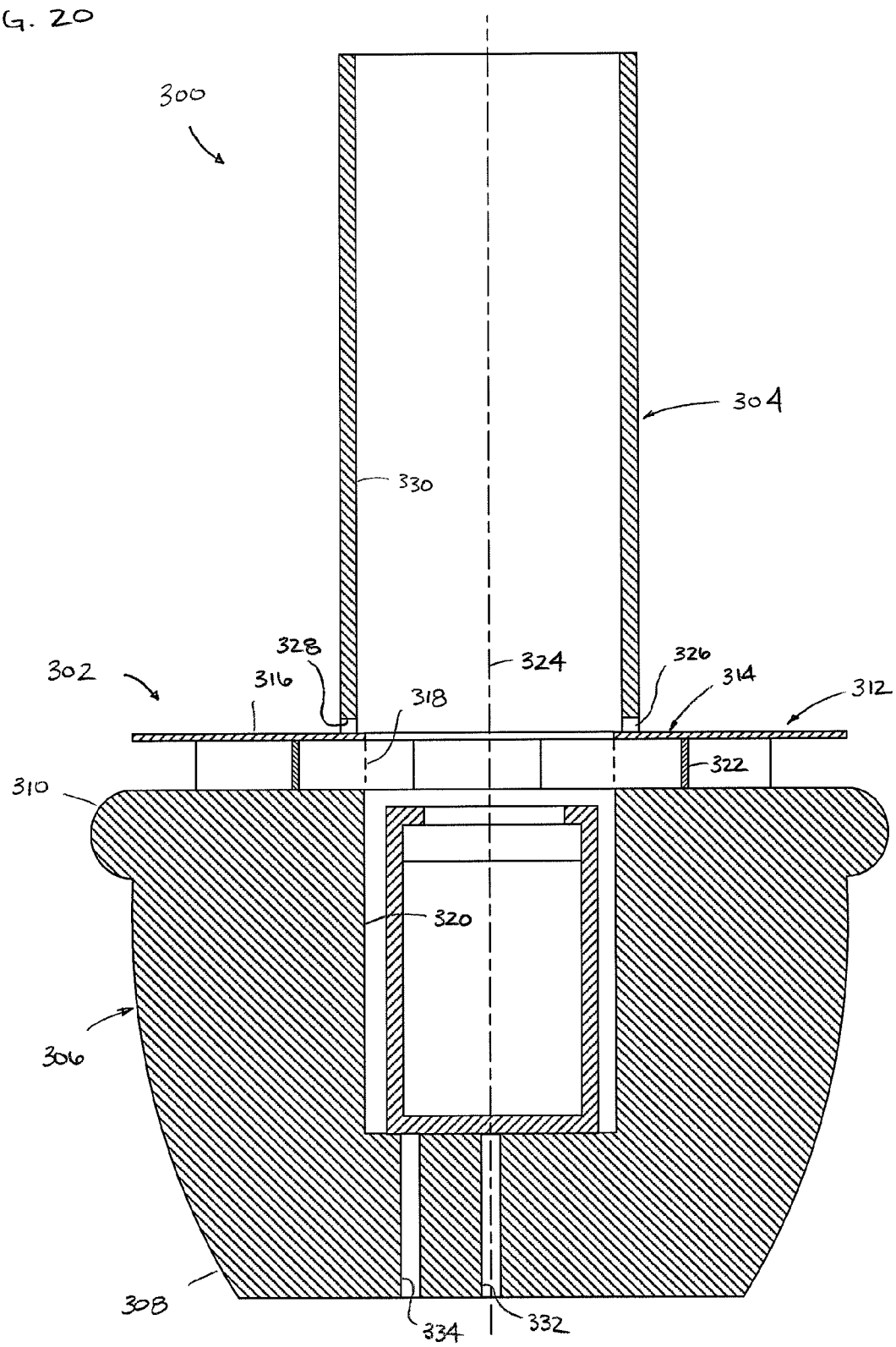
FIG. 20 is a cross-sectional view of an alternate embodiment of a fire container assembly.

Referring now to FIG. 20, an alternate embodiment of a fire container assembly 300 is shown. In the depicted embodiment of FIG. 20, the fire container assembly 300 includes a container 302 and a shield 304.

The container 302 includes a body 306 having a first axial end 308 and a second axial end 310 and an air-intake assembly 312 disposed at the second axial end 310 of the body 306. The body 306 and the air-intake assembly 312 are integral. In the depicted embodiment, the body 306 and the air-intake assembly 312 are molded to form a single piece.

The air-intake assembly 312 includes a top plate 314 having a first axial end 316 and defines a chamber 318 that is aligned with a receptacle 320 in the body 306 of the container 302. The air-intake assembly 312 further includes a plurality of vanes 322 that define a plurality of pathways that direct air to the chamber 318 so that the air in the chamber 318 swirls about a central longitudinal axis 324 of the fire container assembly 300.

In the depicted embodiment of FIG. 20, the shield 304 of the fire container assembly 300 includes an opening 326. The opening 326 is adjacent to a first end surface 328 of the shield 304 and the first axial end 316 of the top plate 314 of the air-intake assembly 312. In one embodiment, the shield 304 is displaced or elevated from the first axial end 316 of the top plate 314 so that the opening 326 is provided between the first end surface 328 of the shield 304 and the first axial end 316 of the top plate 314 of the air-intake assembly 312.

In one embodiment, the opening 326 is less than or equal to about 0.5 inches. In another embodiment, the opening 326 is less than or equal to about 0.25 inches. In another embodiment, the opening 326 is in a range of about 0.125 inches to about 0.25 inches. The opening 326 allows additional air to enter a bore 330 of the shield 304. This additional air acts to cool the temperature of the shield 304.

In the depicted embodiment of FIG. 20, the body 306 of the container 302 defines a mounting hole 332. The mounting hole 332 is adapted to receive a structure (e.g., a post, fastener, etc.) on which the container 302 can be mounted. The container 302 further defines a drainage hole 334. The drainage hole 334 extends from the receptacle 320 through a first end surface 336 of the first axial end 308 of the container 302. The drainage hole 334 is adapted to provide a passage through which water can be drained from the receptacle 320.

Referring now to FIGS. 1, 2, 3 and 19, a method for assembling the fire container assembly 10 will be described. The combustible fuel 41 is inserted into the receptacle 38 of the container 12. In the depicted embodiment of FIG. 2, the combustible fuel 41 is disposed below the first opening 62 of the chamber 57 of the air-intake assembly 14. In this embodiment, the lowermost point (or the ignition point) of the flame 18 is disposed below the first opening 62 of the chamber 57 of the air-intake assembly 14. In an alternate embodiment, the combustible fuel 41 is disposed within the chamber 57 of the air-intake assembly 14 so that the ignition point of the flame 18 is disposed within the chamber 57 of the air-intake assembly 14. In an alternate embodiment, the combustible fuel 41 is disposed within the bore 122 of the shield 16 so that the ignition point of the flame 18 is disposed within the bore 122 of the shield 16.

The air-intake assembly 14 is disposed on the container 12. In the depicted embodiments of FIGS. 1, 2 and 3, the air-intake assembly 14 is disposed on the container 12 so that the second axial end surface 60 of the bottom plate 52 abuts the second end surface 36 of the container 12. In this embodiment, the plurality of tabs 68 (best shown in FIG. 6) generally aligns the chamber 57 of the air-intake assembly 14 with the receptacle 38 of the container 12.

In the depicted embodiment of FIG. 19, an alternate embodiment of an air-intake assembly 14' is shown. The air intake assembly 14' includes a top plate 54' and a plurality of vanes 55'. Each of the vanes 55' includes a first longitudinal side 98' and an oppositely disposed second longitudinal side 100'. The second longitudinal side 100' is engaged to the top plate 54'. The air-intake assembly 14' is disposed on the container 12 so that the first longitudinal sides 98' of the vanes 55' abut the second end surface 36 of the container 12. In the depicted embodiment, the vanes 55' extend directly between the second end surface 36 of the container 12 and the top plate 54'. The air-intake assembly 14' is positioned on the container 12 so that a chamber 57' defined by the air-intake assembly 14' is generally aligned with the receptacle 38 of the container 12.

With the chamber 57 generally aligned with the receptacle 38, the shield 16 is disposed on the top plate 54 of the air-intake assembly 14 so that the bore 122 is generally aligned with the chamber 57 and the receptacle 38. The first end surface 116 of the shield 16 is disposed adjacent to the first axial end 74 of the top plate 54 of the air-intake assembly 14. In the depicted embodiment, the air-intake assembly 14 is disposed immediately between the container 12 and the shield 16.

In one embodiment, the shield 16 is rigidly engaged to the air-intake assembly 14 so that the shield 16 is not removable from the air-intake assembly 14. In another embodiment, the first end surface 116 of the shield 16 is slightly offset from (i.e., lifted off) the first axial end 74 of the top plate 54 of the air-intake assembly 14. This offset creates a space through which air can enter the bore 122 of the shield 16. By allowing some air to enter the bore 122 through this space, the temperature of the shield 16 during operation can be reduced. However, as the size of the space increases, the amount of air directed about the central longitudinal axis 58 decreases.

Referring now to FIGS. 1-19, the operation of the fire container assembly 10 will be described. With the shield 16 and the air-intake assembly 14 removed from the fire container assembly 10, the combustible fuel 41 is ignited. The ignition of the combustible fuel 41 generates the fire 20 that extends from the receptacle 38. With the combustible fuel ignited, the air-intake assembly 14 is placed on the container 12 so that the chamber 57 is aligned with the receptacle 38. The alignment of the chamber 57 and the receptacle 38 allows the fire 20 to pass through the chamber 57. Without the shield 16 placed on the air-intake assembly 14, the fire 20 is generally aligned with the central longitudinal axis 58.

The shield 16 is placed over the fire 20 so that the first end surface 116 is disposed on the first axial end 74 of the top plate 54 of the air-intake assembly 14. As air does not pass through the sidewalls 124 of the shield 16, air is substantially provided to the fire 20 through the pathways 56 of the air-intake assembly 14. Air enters the air-intake assembly 14 through openings 126 in a side portion 128 of the air-intake assembly 14. In the depicted embodiment, the side portion 128 of the air-intake assembly 14 is disposed between outer diameters of the bottom and top plates 52, 54. The openings 126 in the side portion 128 are cooperatively defined by the bottom and top plates 52, 54 and the plurality of vanes 55.

Air flows through the plurality of pathways 56 to the chamber 57. As previously provided, the pathways 56 are oriented so that air from the pathways 56 is directed about or around the central longitudinal axis 58 rather than radially toward the longitudinal axis 58. This direction of the air about or around the central longitudinal axis 58 causes the air to swirl within the chamber 57.

As the air-intake assembly 14 directs air to flow about the central longitudinal axis 58, the flames 18 of the fire 20 are directed about the central longitudinal axis 58 when the shield 16 is disposed on the air-intake assembly 14. In one aspect of the present disclosure, the direction of air about the central longitudinal axis 58 of the chamber 57 causes the fire 20 to swirl about the central longitudinal axis 58. This swirling motion of the flames 18 of the fire 20 creates a decorative effect.

The relationship between the inner diameter $\phi_1$ (shown in FIG. 11) of the chamber 57 and the inner diameter of the bore 122 of the shield 16 affects the flames 18 of the fire 20. In one aspect of the present disclosure, the inner diameter $\phi_1$ of the chamber 57 is less than the inner diameter of the bore 122 of the shield 16. In this embodiment, an outer diameter created by the swirling flames 18 of the fire 20 in the shield 16 approaches the inner diameter of the bore 122 of the shield 16. In another aspect of the present disclosure, as the inner diameter $\phi_1$ of the chamber 57 increases, the outer diameter created by the swirling flames 18 of the fire 20 in the shield 16 decreases. In the depicted embodiment of FIG. 2, the inner diameter $\phi_1$ of the chamber 57 is about equal to the inner diameter of the bore 122 of the shield 16.

In another aspect of the present disclosure, the direction of air about the central longitudinal axis 58 of the chamber 57 causes the height of the flames 18 produced from the fire container assembly 10 to reach higher than the height of the flames produced using the same combustible fuel 41 without the air-intake assembly 14. In one aspect of the present disclosure, the flames 18 reach to the second end 120 of the shield 16.

Various modifications and alterations of this disclosure will become apparent to those skilled in the art without departing from the scope and spirit of this disclosure, and it should be understood that the scope of this disclosure is not to be unduly limited to the illustrative embodiments set forth herein.

What is claimed is:

1. A fire container assembly comprising:

a combustible fuel canister being adapted to provide a flame when ignited;

a container for receiving the combustible fuel canister, the container being configured to substantially surround the combustible fuel canister;

an air-intake assembly disposed adjacent to the container, the air-intake assembly including:

a first plate;

a plurality of vanes engaged to the first plate, each of the vanes having an arcuate shape and a first longitudinal side engaged to the first plate and an oppositely disposed second longitudinal side, the plurality of vanes defining a plurality of pathways; and a chamber cooperatively defined by the first plate and the plurality of vanes, wherein the plurality of pathways direct air about a longitudinal axis of the chamber, and wherein the combustible fuel canister is positioned within the container so that the flame is positioned within the chamber; and a shield disposed on the air-intake assembly, the shield having a body defining a bore that extends longitudinally through the body, the bore being generally aligned with the chamber of the air-intake assembly so that the bore receives the flame from the combustible fuel, wherein the flame is directed about the longitudinal axis in response to air received in the chamber of the air-intake assembly.

2. The fire container assembly of claim 1, wherein the combustible fuel is a gel fuel.

3. The fire container assembly of claim 1, wherein each of the vanes includes a first end and a second ends, the first and second longitudinal sides extending between the first and second end, the second ends of the vanes circumferentially overlapping the first ends of the immediately subsequent vanes.

4. The fire container assembly of claim 1, wherein the air-intake assembly is disposed immediately between the container and the shield.

5. The fire container assembly as claimed in claim 1, wherein the shield is cylindrical in shape.

6. The fire container assembly as claimed in claim 5, wherein the shield is transparent.

7. The fire container assembly as claimed in claim 1, wherein the air-intake assembly includes a second plate that is engaged to the second longitudinal sides of the vanes.

8. The fire container assembly as claimed in claim 7, wherein air-intake assembly includes an inner thickness between the first and second plates that is in a range of about 20% to 30% of the width of the chamber.

9. The fire container assembly as claimed in claim 8, wherein the inner thickness between the first plate and the second plate is in a range of 20% to 30% of an inner diameter of the chamber.

10. The fire container assembly as claimed in claim 8, wherein the inner thickness is about equal to an outer thickness between the first and second plates.

11. A fire container assembly comprising:

a container defining a receptacle;

a tube defining a bore that extends longitudinally through the tube, the bore being generally aligned with the receptacle, the tube including a sidewall that longitudinally surrounds the bore, wherein the sidewall is continuous; and an air-intake assembly disposed between the container and the tube, the air-intake assembly including:

a first plate;

a second plate;

a plurality of vanes engaging the first plate to the second plate, each of the vanes having an arcuate shape and a first longitudinal side engaged to the first plate and an oppositely disposed second longitudinal side engaged to the second plate, the plurality of vanes defining a plurality of pathways; and a chamber cooperatively defined by the first plate, the second plate and the plurality of vanes, wherein the plurality of pathways direct air about a longitudinal axis of the chamber.

12. The fire container assembly of claim 11, wherein the tube is cylindrical in shape.

13. The fire container assembly as claimed in claim 11, wherein the tube is transparent.

14. The fire container assembly of claim 11, further comprising a combustible fuel disposed in the receptacle of the container.

15. The fire container assembly of claim 14, wherein the combustible fuel is a gel fuel.

16. The fire container assembly of claim 11, wherein the air-intake assembly is immediately between the container and the tube.

17. An air-intake assembly adapted for use with a fire container assembly, the air-intake assembly comprising:

a first plate;

a plurality of vanes engaged to the first plate, each of the vanes having an arcuate shape and a first longitudinal side engaged to the first plate and an oppositely disposed second longitudinal side, the plurality of vanes defining a plurality of pathways;

a second plate, wherein the second longitudinal sides of the vanes are engaged to the second plate; and a chamber cooperatively defined by the first plate and the plurality of vanes, the chamber extending through the first plate, wherein the plurality of pathways swirl air substantially about a central axis of the chamber, wherein each of the vanes includes a first end and a second end, the first and second longitudinal sides extending between the first and second ends, the first ends being adjacent to the first and second openings of the first and second plates, the second ends of the vanes extending outwardly from the first and second openings so that the second ends circumferentially overlapping the first ends of the immediately subsequent vanes.

18. The air-intake assembly of claim 17, wherein the first plate includes a first inner portion defining a first opening, the second plate includes a second inner portion defining a second opening.

19. The air-intake assembly of claim 18, wherein an inner thickness between the first and second plates at the first and second openings is in a range of about 20% to 30% of an inner diameter of the chamber.

20. An air-intake assembly configured to provide air to a fire, the air-intake assembly comprising:

at least one plate having a first surface and defining an opening extending from the first surface through the first plate; and a plurality of vanes engaged to the first surface of the first plate and extending outwardly from the first surface, each of the vanes having an arcuate shape, wherein each vane has a first end and a second end, the second end being disposed a greater distance away from the opening than the first end, and wherein at least one imaginary axis extending from the center of the opening and substantially parallel to the first surface intersects at least two of the plurality of vanes, wherein during operation the air-intake assembly is configured to receive air from below the plate and to supply swirling air upwardly to the fire through the opening.

21. A fire container assembly comprising:

a container adapted to receive a combustible fuel;

an air-intake assembly engaged to the container, the air-intake assembly having a body defining:

a chamber having a central axis; and a plurality of arcuate shaped pathways that are configured to direct air about the central axis of the chamber; and a shield disposed adjacent to the air-intake assembly, the shield having a body defining a bore that extends longitudinally through the body, the bore being generally aligned with the chamber of the air-intake assembly so that the bore receives the flame from the combustible fuel, wherein the flame is directed about the central axis in response to air received in the chamber of the air-intake assembly.

22. A fire container assembly comprising:

a container body having a receptacle for receiving a combustible fuel source adapted to provide a flame;

a tubular shield having a continuous sidewall, a top end, and a bottom end together defining an interior chamber, the tubular shield being adapted to surround at least a portion of the flame within the interior chamber; and a plurality of arcuate shaped vanes adapted to direct air about a longitudinal axis of the interior chamber such that at least a portion of the flame swirls within the interior chamber.

23. The fire container assembly of claim 22, wherein the shield is transparent.

24. The fire container assembly of claim 23, wherein the shield is glass.

25. The fire container assembly of claim 22, wherein the tubular shield is in the shape of a cylinder.

26. The fire container assembly of claim 22, wherein the combustible fuel source is a gel fuel.

27. The fire container assembly of claim 22, wherein the plurality of vanes includes at least four vanes.

28. The fire container assembly of claim 22, wherein the plurality of vanes is located between the shield top end and the container body receptacle.

29. The fire container assembly of claim 22, wherein the container body supports the plurality of vanes and the shield.

30. The fire container assembly of claim 22, wherein the assembly is adapted to allow air to flow into the interior chamber from the bottom end of the shield.

31. The fire container assembly of claim 22, wherein the container base includes a drainage hole.

32. The fire container assembly of claim 22, wherein the container base includes a mounting hole.

* * * * *